US011555228B2

(12) United States Patent
Dubach et al.

(10) Patent No.: US 11,555,228 B2
(45) Date of Patent: Jan. 17, 2023

(54) CO-BASED HIGH-STRENGTH AMORPHOUS ALLOY AND USE THEREOF

(71) Applicant: The Swatch Group Research and Development Ltd., Marin (CH)

(72) Inventors: Alban Dubach, Bienne (CH); David Ehinger, Halsbruecke (DE); Mihai Stoica, Zurich (CH)

(73) Assignee: The Swatch Group Research and Development Ltd., Marin (CH)

( * ) Notice: Subject to any disclaimer, the term of this patent is extended or adjusted under 35 U.S.C. 154(b) by 0 days.

(21) Appl. No.: 16/699,326

(22) Filed: Nov. 29, 2019

(65) Prior Publication Data

US 2020/0115775 A1 Apr. 16, 2020

Related U.S. Application Data

(63) Continuation of application No. 15/677,212, filed on Aug. 15, 2017, now abandoned.

(30) Foreign Application Priority Data

Nov. 11, 2016 (EP) ..... 16198457

(51) Int. Cl.
*C22C 19/07* (2006.01)
*C22C 45/04* (2006.01)
(Continued)

(52) U.S. Cl.
CPC ..... *C22C 19/07* (2013.01); *C22C 32/0047* (2013.01); *C22C 45/04* (2013.01); *G04B 1/145* (2013.01)

(58) Field of Classification Search
None
See application file for complete search history.

(56) References Cited

U.S. PATENT DOCUMENTS 4,133,682 A 1/1979 Ray
4,365,994 A * 12/1982 Ray ..... C22C 45/008 148/330
(Continued)

FOREIGN PATENT DOCUMENTS

CN 104532169 A 4/2015
DE 10 2011 001 783 A1 10/2012
(Continued)

OTHER PUBLICATIONS

Combined Russian Office Action and Search Report dated Aug. 31, 2020 in corresponding Russian Patent Application No. 2017135403/05(061769) (with English Translation), 22 pages.
(Continued)

*Primary Examiner* — Xiaobei Wang
(74) *Attorney, Agent, or Firm* — Oblon, McClelland, Maier & Neustadt, L.L.P.

(57) ABSTRACT

The present invention relates to an amorphous alloy corresponding to the formula:

$Co_aNi_bMo_c(C_{1-x}B_x)_dX_e$ wherein X is one or several elements selected from the group consisting of Cu, Si, Fe, P, Y, Er, Cr, Ga, Ta, Nb, V and W; wherein the indices a to e and x satisfy the following conditions:

$55 \leq a \leq 75$ at. %
$0 \leq b \leq 15$ at. %
$7 \leq c \leq 17$ at. %
$15 \leq d \leq 23$ at. %
$0.1 \leq x \leq 0.9$ at. %
$0 \leq e \leq 10$ at. %, each element selected from the group having a content≤3 at. % and preferably ≤2 at. %, the balance being impurities.

15 Claims, 1 Drawing Sheet

(51) Int. Cl.
*C22C 32/00* (2006.01)
*G04B 1/14* (2006.01)

(56) References Cited

U.S. PATENT DOCUMENTS 4,484,184 A * 11/1984 Gregor ..... C22C 45/008 148/304
4,527,614 A 7/1985 Masumoto et al.
4,556,607 A 12/1985 Sastri
4,606,977 A * 8/1986 Dickson ..... B22F 9/002 148/403
4,781,771 A 11/1988 Masumoto et al.
4,806,179 A * 2/1989 Hagiwara ..... C22C 45/008 148/403
2005/0237197 A1 10/2005 Liebermann et al.
2009/0320961 A1* 12/2009 Brunner ..... C22C 45/04 148/104
2013/0126054 A1 5/2013 Aljerf et al.
2013/0133788 A1* 5/2013 Aljerf ..... C22C 19/07 148/403
2014/0283956 A1* 9/2014 Schramm ..... C22C 45/04 148/511

FOREIGN PATENT DOCUMENTS

DE 10 2011 001 784 A1 10/2012
EP 0 002 923 7/1979
JP S6475641 * 3/1989
JP H10-324939 12/1998
JP H10324939 * 12/1998
WO WO 2012/010940 A2 1/2012

OTHER PUBLICATIONS

European Search Report dated Apr. 11, 2017 in European Application 16198457.0 filed on Nov. 11, 2016.
English translation of JPS64-75641, JPO, accessed Mar. 14, 2019.

* cited by examiner

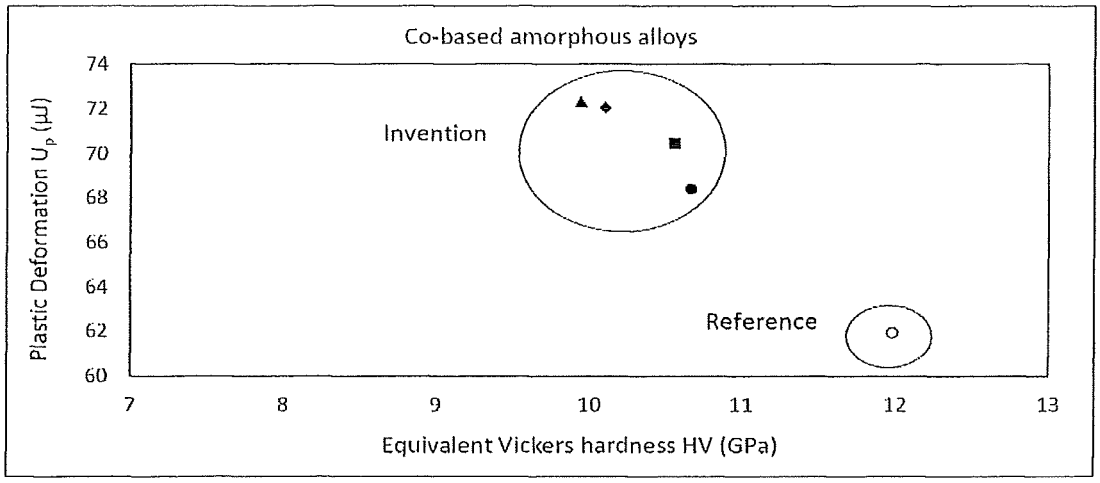
Co-based amorphous alloys
Plastic Deformation $U_p$ (μJ)
74
72
70
68
66
64
62
60
Invention
Reference
7
8
9
10
11
12
13
Equivalent Vickers hardness HV (GPa)

CO-BASED HIGH-STRENGTH AMORPHOUS ALLOY AND USE THEREOF

This application claims priority from European patent application No. 16198457.0 filed on Nov. 11, 2016, the entire disclosure of which is hereby incorporated herein by reference.

FIELD OF THE INVENTION

The invention relates to Co-based amorphous alloys with high strength and ductility properties making them useful for the fabrication of watch components and in particular for the fabrication of springs in mechanically operating watches.

BACKGROUND OF THE INVENTION

Due to the absence of microstructural defects such as grains, grain or twin boundaries, dislocations and stacking faults, metallic glasses (MGs) can offer a good corrosion resistance and a high mechanical strength with fracture strengths above 4 GPa and even 5 GPa. Their unique properties make them attractive for a number of structural applications where high specific strengths and/or elastic storage energies are required. Unfortunately, they are usually inherently brittle and do not show any macroscopic plastic deformation, i.e. ductility, prior to catastrophic failure if tested under tensile or bend loading conditions. The limited or non-existing malleability of MGs is caused by highly localized deformation processes with the rapid propagation of major shear bands and cracks. This lack of ductility hampers their potential for mechanical applications, especially if the fabrication of the structural part involves a room temperature deformation step as for springs in watches.

To be used as springs whilst being competitive with the best crystalline alloy, the amorphous alloy must fulfill several requirements:

High glass forming ability so that it may be synthetized under thick ribbon with a thickness higher than 80 and preferably higher than 100 μm, High fracture strength with values above 3.75 GPa and preferably above 4 GPa, High ductility under bend and compressive loading so that it may be plastically deformed at room temperature.

In the literature, a vast number of Fe- and/or Co-based amorphous alloy compositions are described. Their basic composition often fits the generic formula (Fe, Co)—(P, C, B, Si)—X, where X is at least one additional element among e.g. Nb, Ta, Mo, Al, Ga, Cr, Mn, Cu, V, Zr and rare earth elements. An extensive study on Fe-based compositions, also indexed as "structural amorphous steels", can be found in the following three publications:

Z. Q. Liu, and Z. F. Zhang, "*Mechanical properties of structural amorphous steels: Intrinsic correlations, conflicts, and optimizing strategies,*" *J. Appl. Phys.,* 114(24), 2013.

C. Suryanarayana, and A. Inoue, "*Iron-based bulk metallic glasses,*" *Int. Mater. Rev.,* 58(3):131-166, 2013.

Z. Q. Liu, and Z. F. Zhang, "*Strengthening and toughening metallic glasses: The elastic perspectives and opportunities,*" *J. Appl. Phys.,* 115(16), 2014.

Representative compositions showing strengths above 4 GPa are for example:

Co—(Fe)—Nb—B—(Er, Tb, Y, Dy), Co—(Ir)—Ta—B or Co—Fe—Ta—B—(Mo, Si),

Fe—(Co, Cr, Mn)—Mo—C—B—(Er) or Co—(Fe)—Cr—Mo—C—B—(Er),

Fe—(Co, Ni)—B—Si—Nb—(V) or Co—B—Si—Ta.

In particular, a document of Cheng et al. (Y. Y. Cheng, et al., "*Synthesis of CoCrMoCB bulk metallic glasses with high strength and good plasticity via regulating the metalloid content,*" *J. Non-Cryst. Solids,* 410:155-159, 2015) discloses an amorphous alloy $Co_{50}Cr_{15}Mo_{14}C_xB_y$ with a compressive strength above 4.5 GPa.

The problem of the majority of these high-strength alloys is that they show a cleavage-like fracture behavior and hence offer no or a quite limited plastic formability.

Several phosphorus containing Fe— and/or Co-based amorphous systems with ductility improvement are known from the following documents.

T. Zhang, et al., "*Ductile Fe-based bulk metallic glass with good soft-magnetic properties,*" *Mater. Trans.,* 48(5): 1157-1160, 2007.

K. F. Yao, and C. Q. Zhang, "*Fe-based bulk metallic glass with high plasticity,*" *Appl. Phys. Left.,* 90(6), 2007.

A. Inoue, et al., "*Mechanical properties of Fe-based bulk glassy alloys in Fe—B—Si—Nb and Fe—Ga—P—C—B—Si systems,*" *J. Mater. Res.,* 18(6):1487-1492, 2003.

M. Stoica, et al., "*Mechanical behavior of* $Fe_{65.5}Cr_4Mo_4Ga_4P_{12}C_5B_{5.5}$ *bulk metallic glass,*" *Intermetallics,* 13(7):764-769, 2005.

A. Seifoddini, et al., "*New* $(Fe_{0.9}Ni_{0.1})_{77}Mo_5P_9C_{7.5}B_{1.5}$ *glassy alloys with enhanced glass-forming ability and large compressive strain,*" *Mat. Sci. Eng. A,* 560:575-582, 2013.

S. F. Guo, et al., "*Enhanced plasticity of Fe-based bulk metallic glass by tailoring microstructure,*" *T. Nonferr. Metal. Soc.,* 22(2):348-353, 2012.

S. F. Guo, and Y. Shen, "*Design of high strength Fe—(P, C)-based bulk metallic glasses with Nb addition,*" *T. Nonferr. Metal. Soc,* 21(11):2433-2437, 2011.

W. Chen, et al., "*Plasticity improvement of an Fe-based bulk metallic glass by geometric confinement,*" *Mater. Lett.,* 65(8):1172-1175, 2011.

X. J. Gu, et al., "*Mechanical properties, glass transition temperature, and bond enthalpy trends of high metalloid Fe-based bulk metallic glasses,*" *Appl. Phys. Lett.,* 92(16), 2008.

L. Y. Bie, et al., "*Preparation and properties of quaternary CoMoPB bulk metallic glasses,*" *Intermetallics,* 71:7-11, 2016.

H. T. Miao, et at., "*Fabrication and properties of soft magnetic Fe—Co—Ni—P—C—B bulk metallic glasses with high glass-forming ability,*" *J. Non-Cryst. Solids,* 421:24-29, 2015.

However, the yield or fracture strengths of these systems are generally below 3.5 GPa and therefore they are not appropriate for our purposes.

In the patent literature, numerous documents disclose Fe— and/or Co-based amorphous alloys. Many of them cover amorphous compositions used for magnetic applications and no details about mechanical properties, i.e. strength and ductility, are presented. The documents WO 2012/010940, WO 2012/010941, WO 2010/027813, DE 10 2011 001 783 and DE 10 2011 001 784 can however be considered as an exception in view of the fact that they aim for protecting ductile, high strength alloys. However, the bendability as ribbon is generally limited to a maximum thickness of 86 μm for the Fe—, Co-based alloys unlike the present invention aiming to develop thicker ribbons.

SUMMARY OF THE INVENTION

The present invention aims to develop an amorphous alloy fulfilling the requirements of ductility and strength whilst having a high glass forming ability to manufacture thick watch components. More precisely, the present invention aims to develop an amorphous alloy meeting the requirements specified above.

To this end, a composition according to claim 1 is proposed and particular embodiments are given in the dependent claims.

BRIEF DESCRIPTION OF THE DRAWINGS

FIG. 1 represents the plastic deformation energy of different alloys during nanoindentation (P=3 mN) as a function of their equivalent Vickers hardness.

DETAILED DESCRIPTION OF THE INVENTION

The invention relates to a Co-based amorphous alloy. By amorphous alloy is meant a fully amorphous alloy or a partially amorphous alloy with a volume fraction of amorphous phase higher than 50%. This amorphous alloy corresponds to the following formula:

$$Co_aNi_bMo_c(C_{1-x}B_x)_dX_e$$

wherein X is one or several elements selected from the group consisting of Cu, Si, Fe, P, Y, Er, Cr, Ga, Ta, Nb, V and W; wherein the indices a to e and x satisfy the following conditions:

$55 \leq a \leq 75$ at. %, preferably $60 \leq a \leq 70$ at. %, $0 \leq b \leq 15$ at. %, preferably $0 \leq b \leq 10$ at. %, $7 \leq c \leq 17$ at. %, preferably $10 \leq c \leq 15$ at. %, $15 \leq d \leq 23$ at. %, preferably $17 \leq d \leq 21$ at. %, $0.1 \leq x \leq 0.9$ $0 \leq e \leq 10$ at. %, preferably $0 \leq e \leq 5$ at. % and more preferably $0 \leq e \leq 3$ at. %, each element selected from the group having a content below 3 at. % and preferably below 2 at. %, the balance being impurities with a maximum of 2 at. %.

In the impurities are included small amounts (≤0.5 at. %) of oxygen or nitrogen.

This amorphous alloy can be synthesized as thick ribbon, thick foil, wire or more generally as small bulk specimen, with a minimum thickness of 80 μm and preferably of 100 μm.

The amorphous alloy exhibits a fracture strength above 3.75 GPa and preferably above 4 GPa and a large plastic elongation above 3% under compressive loading. It also exhibits high ductility under 180° bend tests for specimens with a thickness above 80 μm.

These properties make them particularly suitable for manufacturing watch components like springs by cold forming.

The process for manufacturing the amorphous alloy may be any conventional process such as melt-spinning, twin-roll casting, planar flow casting or further rapid cooling processes. Although not required, the process may comprise a subsequent step of heat treatment. This heat treatment can be carried out at temperatures below $T_g$ for relaxation or change in free volume, in the supercooled liquid region $\Delta T_x$ or slightly above $T_{x1}$. A heat treatment of the alloy above $T_g$ can be carried out to nucleate a certain fraction of nanoscale precipitates like α-Co precipitates. The alloy can also be subjected to cryogenic thermal cycling in order to achieve a rejuvenation of the amorphous matrix.

Hereinafter, the present invention is described in further detail through examples.

EXAMPLES

Experimental Procedure

Sample Preparation

The master alloys were prepared in an alumina or quartz crucible by induction melting mixtures of pure Co, Fe, Cr, Ni, Mo, graphite (99.9 wt. %) and pre-alloys of $Co_{80}B_{20}$ (99.5 wt. %). If necessary, the ingots were homogenized by arc-melting. Ribbons with thicknesses between 55 and 160 μm and widths in the range of 1 and 5 mm were subsequently fabricated from the master alloys by the Chill-Block Melt Spinning (CBMS) technique with a single-roller melt-spinner. The process atmosphere was inert gas or $CO_2$. In general, for a ribbon thickness t>100 μm, a wheel speed≤13 mm/s had to be applied.

Sample Characterization

The ribbons were evaluated with respect to their thermal, structural and mechanical properties by differential scanning calorimetry (DSC) at a constant heating rate of 20 K/min and under a flow of purified argon, by X-ray diffraction analyses, by optical stereoscopy and by mechanical testing. The X-ray measurements were performed in reflection configuration with Co—Kα radiation and within a range of 2θ=20 . . . 80° or 10 . . . 100°.

Selected material variants with sufficient glass-forming ability were cast to Ø1 mm rods with a final aspect ratio of 2:1 to determine their mechanical properties under quasi-static compressive loading ($\dot{\varepsilon}=10^{-4}s^{-1}$) as recommended by ASTM E9, using an electromechanical universal testing machine. At least three specimens were tested for the selected compositions.

To estimate the strength and failure strain of glassy ribbons, additional two-point bending tests were carried out. This test was first developed for optical glass fibers and finally applied on melt-spun ribbons (see for example WO 2010 027813). In this test, the ribbon is bent into a "U" shape and subjected to a constrained compressive loading between two co-planar and polished faceplates until fracture (one faceplate stationary). The two-point bending tests were carried out by means of a miniaturized computer-controlled tensile/compressive device at a constant traverse speed of 5 μm/s. The stop of the motor movement due to the fracture of the tape was achieved by adjusting a defined load drop criterion (viz, load decrease of 10% relative to the maximum load). The failure strength $\sigma_{b,f}$ of the specimen is described by the maximum tensile load $F_{max}$ in the outer surface given from the faceplace separation at fracture $D_f$:

$$\sigma_{b,f} = \frac{t}{2}(2EF_{max}/I)^{1/2} = 1.19784E\frac{t}{D_f - t}$$

where E is the Young's modulus, t the thickness and I the second moment of cross-sectional area ($I=bt^3/12$) of the ribbons. For the calculation of the failure strength in the examples, a Young's modulus of $E_{av}=155$ GPa, indicating an average value derived from the elastic slopes of the load versus displacement curves, has been used.

Based on the assumption that the tape undergoes an elastic deformation until fracture, the failure strain can be directly calculated by $$\varepsilon_{b,f} = \frac{\sigma_{b,f}}{E}.$$

Even if plastic deformation occurs, this method still provide a relative measure of strength. For each alloy, at least three samples of a same thickness were tested. It is the free side of the ribbons, i.e. the side not in contact with the wheel's surface, that was subject to the tension.

Additionally, primitive 180° bend tests were applied on ribbons of different compositions and thicknesses inducing a high strain in their outer fiber loaded under tension. The ribbon is considered to be ductile if it does not break when folded at 180°. The bending ability of the specimens has been tested for both sides of the ribbon for each specimen.

Moreover, nanoindentation measurements were conducted to evaluate and distinguish the ribbons with respect to their stiffness, hardness and performed deformation work. The nanoindentation experiments were carried on polished flat specimens at room temperature in the load control mode by using a UNAT nanoindenter (ASMEC laboratories) equipped with a triangular diamond Berkovich tip. A maximum load of 3 mN as well as a constant strain rate of 0.046 $s^{-1}$ were applied. On each sample at least 10 indents for every loading were placed in a linear array and in a distance of 20 μm. The hardness and reduced elastic modulus values were derived from the unloading part of the load vs. displacement curves according to Oliver and Pharr's principle (W. C. Oliver, and G. M. Pharr, "*An improved technique for determining hardness and elastic-modulus using load and displacement sensing indentation experiments,*" *J. Mater. Res.,* 7(6):1564-1583, 1992) and considering the corrections with regard to thermal drift, contact area (calibrated with a fused quartz plate), instrument compliance, initial penetration depth (zero point correction), lateral elastic displacement of the sample surface (radial displacement correction) and contact stiffness. Hence, the elastic reduced modulus $E_r$ is determined by $$E_r=(\sqrt{\pi}S)/(2\beta A_c^{1/2})$$

where S is the contact stiffness of the sample, β is a constant depending on the indenter geometry and $A_c$, is the projected area of contact for the indentation depth $h_c=h_{max}-\varepsilon P_{max}/S$ with a maximal displacement $h_{max}$ at maximum load $P_{max}$. β and ε are tip-dependent constants, given by β=1.05 (W. C. Oliver, and G. M. Pharr, "*Measurement of hardness and elastic modulus by instrumented indentation: Advances in understanding and refinements to methodology,*" *J. Mater. Res.,* 19(1):3-20, 2004) and ε=0.75 (ISO 14577-1:2015. *Metallic materials—Instrumented indentation test for hardness and materials parameters Part* 1: *Test method,* 2015). The equivalent Vickers HV hardness is correlated to the indentation hardness $H_{IT}=P_{max}/A_c$ by the following term:

$$HV(GP\alpha)=0.92671H_{IT}.$$

However, the hardness calculated by nanoindentation depends on the loading rate and the maximum applied load, and due to the indentation-size effect often not reflects the hardness values from macro- or microhardness measurements.

The deformation energies during nanoindentation were determined from the areas between the unloading curve and the x-axis (elastic deformation energy, $U_{el}$) and between the loading curve and the x-axis (total deformation work, $U_{tot}$). Therefore, the plastic deformation energy, $U_p$ can be derived from the relationship $U_t$-$U_{el}$.

Results

Table 1 below lists the tested Co—Mo—C—B—X as-cast ribbons processed under vacuum/argon atmosphere (chamber pressure of 300 mbar). The alloy compositions include comparative examples and examples according to the invention. In the comparative alloys, the Cr content ranges from 5 to 15 atomic percent and the alloy may additionally comprise Fe with a content of 5 atomic percent. In the alloys according to the invention, the Fe and Cr contents are reduced and even suppressed to improve the ductility whilst keeping high fracture strength as shown hereafter.

In Table 1, the DSC data related to the onsets of glass transition ($T_g$) and primary crystallization ($T_{x1}$), the melting ($T_m$) and liquidus temperatures ($T_{liq}$) as well as the width of the supercooled liquid region ($\Delta T_x$) are given.

For all the ribbons, the microstructures are fully amorphous or partially amorphous with the presence of some crystallites containing at least α-Co precipitates for the compositions $Co_{60}Ni_5Mo_{14}C_{18}B_3$, $Co_{60.6}Ni_{9.15}Mo_{10.1}C_{14}B_4Si_{1.9}Cu_{0.17}$, $Co_{61.4}Ni_{5.2}Mo_{14.33}C_{14.3}B_3Si_{1.7}Cu_{0.07}$ and $Co_{69}Mo_{10}C_{14}B_7$ and mostly carbide and boride phases for the $(Co_{60}Ni_5Mo_{14}C_{15}B_6)_{99}V_1$. For the alloys of the invention, the structures are amorphous for a thickness of minimum 80 μm.

Table 2 summarizes the mechanical properties under quasi-static compressive loading at room temperature for some samples. The reduction of the Cr content results in a significant increase in plasticity combined with a minor degradation of the ultimate fracture strength. The iron content was kept below 5% in order to keep the total Poisson's ratio (and hence the ductility of the alloy) as high as possible. The mechanical responses of the $Co_{60}Ni_5Mo_{14}C_{15+x}B_{6-x}$ alloys are characterized by a very high maximum stress level above 3.75 GPa with a pronounced plastic deformation. By taking the fully amorphous $Co_{60}Ni_5Mo_{14}C_{15+x}B_{6-x}$ rods as example, average values of $\sigma_{c,y}$=3959 MPa, $\sigma_{c,\ f}$=4262 MPa and $\varepsilon_{c,\ pl}$=6.3% were determined.

The experimental results of the two-point bending tests and 180° bending tests on as-cast ribbons are listed in Tables 3 and 4 respectively. As shown in Table 3, failure strength higher than 4500 MPa is obtained for the alloys according to the invention. As seen from Table 4, the alloys according to the invention exhibit bendability for ribbons with a thickness higher than 80 μm and even higher than 100 μm.

TABLE 1

| | Alloy | t (μm) | Structure | $T_g$ (K) | $T_{x1}$ (K) | $\Delta T_x$ (K) | $T_m$ (K) | $T_{liq}$ (K) |
|---|---|---|---|---|---|---|---|---|
| Comparative examples | $Co_{45}Fe_5Cr_{15}Mo_{14}C_{10}B_{11}$ | 56 | Am. | 829 | 922 | 93 | 1382 | 1457 |
| | $Co_{45}Fe_5Cr_{10}Ni_5Mo_{14}C_{10}B_{11}$ | 62 | Am. | 799 | 876 | 77 | 1352 | 1403 |
| | $Co_{45}Fe_5Cr_5Ni_{10}Mo_{14}C_{10}B_{11}$ | 59 | Am. | 763 | 806 | 43 | 1405 | 1430 |
| | $Co_{50}Cr_{10}Ni_5Mo_{14}C_{10}B_{11}$ | 133 | Am. | 805 | 879 | 74 | 1348 | 1399 |
| | $Co_{50}Cr_5Ni_{10}Mo_{14}C_{10}B_{11}$ | 94 | Am. | 779 | 836 | 57 | 1341 | 1402 |
| Examples of the invention | $Co_{60}Ni_5Mo_{14}C_{15}B_6$ | 130 | Am. | 745 | 788 | 43 | 1396 | 1436 |
| | $Co_{60}Ni_5Mo_{14}C_{16}B_5$ | 133 | Am. | 745 | 794 | 49 | 1396 | 1433 |
| | $Co_{60}Ni_5Mo_{14}C_{17}B_4$ | 83 | Am. | 748 | 795 | 47 | — | — |
| | $Co_{60}Ni_5Mo_{14}C_{18}B_3$ | 133 | Am./cryst.* | 739 | 778 | 39 | 1396 | 1443 |
| | $Co_{60}Ni_9Mo_{10}C_{15}B_4Si_2$ | 94 | Am. | 668 | 695 | 27 | 1399 | — |
| | $(Co_{60}Ni_5Mo_{14}C_{15}B_6)_{99}V_1$ | 110 | Am./cryst.** | 763 | 815 | 52 | — | — |
| | $Co_{60.6}Ni_{9.16}Mo_{10.1}C_{14}B_4Si_{1.9}Cu_{0.17}$ | 158 | Am./cryst.* | 676 | 694 | 18 | 1405 | 1453 |
| | $Co_{60.44}Ni_{5.1}Mo_{14.04}C_{14.1}B_4Si_{1.96}Cu_{0.36}$ | 138 | Am. | 723 | 747 | 24 | 1402 | 1443 |
| | $Co_{61.4}Ni_{5.2}Mo_{14.33}C_{14.3}B_3Si_{1.7}Cu_{0.07}$ | 150 | Am./cryst.* | 714 | 760 | 46 | 1399 | 1458 |
| | $Co_{64}Ni_5Mo_{10}C_{15}B_6$ | 125 | Am. | 702 | 717 | 15 | 1396 | 1425 |
| | $Co_{65}Mo_{14}C_{15}B_6$ | 118 | Am. | 767 | 820 | 53 | — | — |
| | $Co_{65}Mo_{14}C_{17}B_4$ | 86 | Am. | 766 | 812 | 46 | — | — |
| | $Co_{69}Mo_{10}C_{15}B_6$ | 100 | Am. | 732 | 776 | 44 | — | — |
| | $Co_{69}Mo_{10}C_{14}B_7$ | 107 | Am./cryst.* | 737 | 779 | 42 | — | — |

Am. = X-ray fully amorphous, cryst. = presence of crystallites,

*= α-Co precipitates,

**= Mostly carbides and borides

TABLE 2

| | Alloy | $\sigma_{c,y}$ (MPa) | $\sigma_{c,f}$ (MPa) | $\varepsilon_{c,pl}$ (%) |
|---|---|---|---|---|
| Comparative examples | $Co_{45}Fe_5Cr_{15}Mo_{14}C_{10}B_{11}$ | 4232 | 4659 | 1.3 |
| | $Co_{45}Fe_5Cr_{10}Ni_5Mo_{14}C_{10}B_{11}$ | 4278 | 4587 | 2.2 |
| | $Co_{45}Fe_5Cr_5Ni_{10}Mo_{14}C_{10}B_{11}$ | 4146 | 4484 | 3.1 |
| | $Co_{50}Cr_{10}Ni_5Mo_{14}C_{10}B_{11}$ | 4193 | 4571 | 2.5 |
| | $Co_{50}Cr_5Ni_{10}Mo_{14}C_{10}B_{11}$ | 4238 | 4369 | 1.8 |
| Example of the invention | $Co_{60}Ni_5Mo_{14}C_{15}B_6$ | 3959 | 4262 | 6.3 |

TABLE 3

| | Alloy | t (μm) | Structure | E (GPa) | $D_f$ (mm) | $\sigma_{b,f}$ (MPa) | $\varepsilon_{b,f}$ (%) |
|---|---|---|---|---|---|---|---|
| Examples of the invention | $Co_{60}Ni_5Mo_{14}C_{16}B_5$ | 123 | Am. | 155 | 4.15 | 5500 | 3.64 |
| | $Co_{60.44}Ni_{5.1}Mo_{14.04}C_{14.1}B_4Si_{1.96}Cu_{0.36}$ | 115 | Am. | 155 | 3.48 | 5860 | 3.65 |
| | $Co_{61.4}Ni_{5.2}Mo_{14.33}C_{14.3}B_3Si_{1.7}Cu_{0.07}$ | 94 | Am./cryst. | 155 | 3.74 | 4880 | 3.09 |
| | | 108 | Am./cryst. | 155 | 4.36 | 4790 | 3.31 |

TABLE 4

| | Alloy | t (μm) | Processing atmosphere | Structure | Bendability (free side and wheel side) |
|---|---|---|---|---|---|
| Comparative examples | $Co_{45}Fe_5Cr_{15}Mo_{14}C_{10}B_{11}$ | 49-56 | Vacuum/Ar | Am. | No |
| | $Co_{45}Fe_5Cr_{10}Ni_5Mo_{14}C_{10}B_{11}$ | 53-54 | Vacuum/Ar | Am. | No |
| | $Co_{45}Fe_5Cr_5Ni_{10}Mo_{14}C_{10}B_{11}$ | 60-61 | Vacuum/Ar | Am. | No |
| | $Co_{50}Cr_{10}Ni_5Mo_{14}C_{10}B_{11}$ | 54-67 | Vacuum/Ar | Am. | No |
| | | 66-67 | $CO_2$ | Am. | No |
| | $Co_{50}Cr_5Ni_{10}Mo_{14}C_{10}B_{11}$ | 78-90 | Vacuum/Ar | Am. | No |
| | | 91-94 | $CO_2$ | Am. | No |
| Examples of the invention | $Co_{60}Ni_5Mo_{14}C_{15}B_6$ | 99-105 | Vacuum/Ar | Am. | Yes |
| | | 92-116 | $CO_2$ | Am. | Yes |
| | $Co_{60}Ni_5Mo_{14}C_{16}B_5$ | 118-133 | Vacuum/Ar | Am. | Yes |
| | $Co_{60}Ni_5Mo_{14}C_{17}B_4$ | 65-89 | Vacuum/Ar | Am. | Yes |
| | $Co_{60}Ni_5Mo_{14}C_{18}B_3$ | 105-133 | Vacuum/Ar | Am./cryst. | Yes |
| | $Co_{60}Ni_9Mo_{10}C_{15}B_4Si_2$ | 83-94 | Vacuum/Ar | Am. | Yes |
| | $(Co_{60}Ni_9Mo_{10}C_{15}B_6)_{99}V_1$ | 110-133 | Vacuum/Ar | Am./cryst. | Yes |
| | $Co_{60.6}Ni_{9.15}Mo_{10.1}C_{14}B_4Si_{1.9}Cu_{0.17}$ | 113-158 | Vacuum/Ar | Am./cryst. | Yes |
| | $Co_{60.44}Ni_{5.1}Mo_{14.04}C_{14.1}B_4Si_{1.96}Cu_{0.36}$ | 79-84 | Vacuum/Ar | Am. | Yes |
| | $Co_{61.4}Ni_{5.2}Mo_{14.33}C_{14.3}B_3Si_{1.7}Cu_{0.07}$ | 94-100 | Vacuum/Ar | Am./cryst. | Yes |
| | $Co_{64}Ni_5Mo_{10}C_{15}B_6$ | 92-125 | Vacuum/Ar | Am. | Yes |
| | $Co_{65}Mo_{14}C_{15}B_6$ | 81-118 | Vacuum/Ar | Am. | Yes |
| | $Co_{65}Mo_{14}C_{17}B_4$ | 79-86 | Vacuum/Ar | Am. | Yes |
| | $Co_{69}Mo_{10}C_{15}B_6$ | 90-100 | Vacuum/Ar | Am. | Yes |
| | $Co_{69}Mo_{10}C_{14}B_7$ | 87-107 | Vacuum/Ar | Am./cryst. | Yes |

The nanoindentation tests were conducted on the as-cast and polished ribbons of the compositions $Co_{50}Cr_{10}Ni_5Mo_{14}C_{10}B_{11}$, $Co_{60}Ni_5Mo_{14}C_{16}B_5$, $Co_{60.44}Ni_{5.1}Mo_{14.04}C_{14.1}B_4Si_{1.96}Cu_{0.36}$ and $Co_{61.4}Ni_{5.2}Mo_{14.33}C_{14.3}B_3Si_{1.7}Cu_{0.07}$. The results for the elastic reduced modulus $E_r$ and the deformation energies with respect to the applied load P are listed in Table 5. As shown in FIG. 1, the plastic deformation energy of the investigated materials is nearly indirectly proportional to their hardness. Hence, the higher $U_p$ values obtained for the CoNiMoCB(Si, Cu) ribbons (filled markers) as compared to the reference $Co_{50}Cr_{10}Ni_5Mo_{14}C_{10}B_{11}$ (unfilled marker) are a further indication of their improved malleability and bendability.

The results have shown that the novel amorphous alloys according to the invention are able to fulfill the three requirements of high glass forming ability, high strength and high ductility. The examples of the invention cover compositions with an alloying element X being Si, V and/or Cu. However, minor additions (≤2% atomic percent) of other elements can be considered without significantly altering the properties of the alloy. Thereby, the present invention also covers X element being selected from the group consisting of P, Y, Er (≤1% atomic percent), Ga, Ta, Nb and W. Minor additions of Fe and Cr (≤3% and preferably ≤2% atomic percent) may also be considered without significantly affecting the properties of the amorphous alloys.

What is claimed is:

1. An amorphous alloy consisting of the formula:

$$Co_aNi_bMo_c(C_{1-x}B_x)_dX_e$$

wherein X is one or several elements selected from the group consisting of Cu, Si, Fe, P, Y, Er, Cr, Ga, Ta, Nb, V and W;

wherein the indices a to e and x satisfy the following conditions:

60≤a≤70 at. %

0≤b≤10 at. %

10≤c≤15 at. %

17≤d≤21 at. %

0.1≤x≤0.45

0≤e≤5 at. %, each element selected from the group having a content below ≤3 at. %, the balance being impurities, wherein the amorphous alloy does not break when folded 180° when the amorphous alloy is in the form of a ribbon having a thickness of 80 μm.

2. The amorphous alloy according to claim 1, wherein 0≤e≤3 at. %.

3. The amorphous alloy according to claim 1, wherein Cr content=0 at. %.

4. The amorphous alloy according to claim 1, wherein Fe content=0 at. %.

5. The amorphous alloy according to claim 1, wherein Cu content is ≤1 at. %.

TABLE 5

| | Alloy | P (mN) | $E_r$ (GPa) | HV (GPa) | $U_{tot}$ (μJ) | $U_p$ (μJ) | $U_{el}$ (μJ) |
|---|---|---|---|---|---|---|---|
| Comparative example | $Co_{50}Cr_{10}Ni_5Mo_{14}C_{10}B_{11}$ | 3 | 177.7 | 11.98 | 113.09 | 61.94 | 51.15 |
| Examples of the Invention | $Co_{60}Ni_5Mo_{14}C_{16}B_5$ | 3 | 168.2 | 10.67 | 120.54 | 68.41 | 52.12 |
| | $Co_{60.6}Ni_{9.15}Mo_{10.1}C_{14}B_4Si_{1.9}Cu_{0.17}$ | 3 | 155 | 10.1 | 125.42 | 72.04 | 53.39 |
| | $Co_{60.44}Ni_{5.1}Mo_{14.04}C_{14.1}B_4Si_{1.96}Cu_{0.36}$ | 3 | 159.4 | 10.56 | 122.88 | 70.46 | 52.42 |
| | $Co_{61.4}Ni_{5.2}Mo_{14.33}C_{14.3}B_3Si_{1.7}Cu_{0.07}$ | 3 | 125.9 | 9.94 | 135.64 | 72.31 | 63.33 |

6. The amorphous alloy according to claim 1, having a fracture strength under compressive loading above 3750 mPa.

7. The amorphous alloy according to claim 1 comprising α-Co precipitates.

8. A ribbon, wire or foil made of the amorphous alloy according to claim 1, having a thickness or diameter above 80 μm.

9. A watch component made of the amorphous alloy according to claim 1.

10. A watch comprising the watch component according to claim 9.

11. The amorphous alloy according to claim 1, wherein $0 \leq e \leq 5$ at. %, each element selected from the group having a content≤2 at. %.

12. The amorphous alloy according to claim 1, having a fracture strength under compressive loading above 4000 mPa.

13. A ribbon, wire or foil made of the amorphous alloy according to claim 1, having a thickness or diameter above 100 μm.

14. A spring made of the amorphous alloy according to claim 1.

15. The amorphous alloy according to claim 1, wherein $0.1 \leq x \leq 0.33$.

* * * * *